US010259693B1

(12) United States Patent
Wilburn, Jr.

(10) Patent No.: US 10,259,693 B1
(45) **Date of Patent: *Apr. 16, 2019**

(54) ELECTRONICALLY CONTROLLED CLUTCH FOR A WINCH

(71) Applicant: Ramsey Winch Company, Tulsa, OK (US)

(72) Inventor: Harold Wilburn, Jr., Haskell, OK (US)

(73) Assignee: Ramsey Winch Company, Tulsa, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/784,984

(22) Filed: Oct. 16, 2017

Related U.S. Application Data

(63) Continuation of application No. 14/155,541, filed on Jan. 15, 2014, now Pat. No. 9,790,063.

(51) Int. Cl.
*B66D 1/12* (2006.01)

(52) U.S. Cl.
CPC ..... *B66D 1/12* (2013.01)

(58) Field of Classification Search
CPC ..... B66D 1/12; B66D 1/14; B66D 1/16
See application file for complete search history.

(56) References Cited

U.S. PATENT DOCUMENTS 2,006,476 A * 7/1935 Payson ..... B66D 1/14 254/351
2,315,628 A 4/1943 Lamond
2,503,146 A 4/1950 Anketell
2,652,230 A * 9/1953 Hoyle ..... B66C 13/26 254/346
2,848,179 A 8/1958 Troxell et al.
3,156,429 A 11/1964 Jones, Jr.
3,249,336 A 5/1966 Brown et al.
3,435,928 A 4/1969 Horning
3,834,670 A * 9/1974 Pityo ..... B66D 1/16 114/210
3,836,121 A 9/1974 Jones
4,398,698 A * 8/1983 Crawford ..... B66D 5/26 254/291
5,238,200 A 8/1993 Ritzenthaler
5,970,906 A * 10/1999 Hrescak ..... B63B 23/50 114/378
6,474,588 B2 * 11/2002 Valverde ..... B63B 35/816 114/254
6,995,682 B1 * 2/2006 Chen ..... B66D 1/46 340/12.22
7,270,312 B1 * 9/2007 Phipps ..... B66D 1/22 254/278
7,891,641 B1 * 2/2011 Miller ..... B66D 1/16 254/344

(Continued)

*Primary Examiner* — Michael E Gallion
(74) *Attorney, Agent, or Firm* — Gable Gotwals

(57) ABSTRACT

An electronic actuated clutch for a winch. The winch having a motor and drive shaft which are engagable, via an electronically actuated clutch, to a spool. The clutch being operated by a solenoid which engages the clutch via a yoke. The clutch is operable between an engaged and disengaged position through energizing and de-energizing the solenoid. Operation of the clutch moves it linearly along the axis of the drive shaft into and out of engagement with the spool. Operation of the electronically actuated clutch may be done via a remote control.

17 Claims, 4 Drawing Sheets

(56) References Cited

U.S. PATENT DOCUMENTS

| | | | | |
|---|---|---|---|---|
| 7,984,894 | B1 * | 7/2011 | Chauza | B66D 1/16 254/344 |
| 8,061,790 | B2 | 11/2011 | Anikhindi et al. | |
| 8,968,140 | B1 * | 3/2015 | Wilburn, Jr. | B66D 5/02 475/156 |
| 9,790,063 | B1 * | 10/2017 | Wilburn, Jr. | B66D 1/12 |
| 2002/0005451 | A1 * | 1/2002 | Valverde | B63B 35/816 242/390.2 |
| 2014/0217341 | A1 * | 8/2014 | Nam | B66D 1/14 254/317 |
| 2014/0252286 | A1 * | 9/2014 | Averill | B66D 1/16 254/344 |
| 2017/0259941 | A1 * | 9/2017 | Briggs, IV | B64F 3/02 |
| 2017/0320709 | A1 * | 11/2017 | Frazier | B66D 1/22 |

* cited by examiner

ELECTRONICALLY CONTROLLED CLUTCH FOR A WINCH

CROSS-REFERENCE TO PENDING APPLICATIONS

The Present application is a continuation of pending U.S. patent application Ser. No. 14/155,541, filed Jan. 15, 2014.

FIELD OF THE INVENTION

The present invention relates generally to winch. More particularly, the present invention relates to a solenoid activated clutch assembly for a winch.

BACKGROUND OF THE INVENTION

Winches are used in numerous applications to lift or move heavy loads. Common applications include mounting them on tow trucks to pull a disabled vehicle onto the bed of the tow truck or lift one end of the disabled vehicle so that it can be hauled away. Another common application is to mount on the front or rear end of a vehicle to assist in retrieving the vehicle where it is stuck.

In order to operate a winch it is necessary to be able to pull line off of the spool as well as be able retrieve the line with a load on it. Pulling line off of the spool or paying it out can be done by running the motor backwards such that the spool unwinds the line. While this method will work, it is often time consuming, especially if a significant amount of line must be paid out. In these situations it is beneficial to disengage the spool from the drive mechanism. This allows the spool to rotate freely and for the line to be manually pulled off of the spool. Disengaging the spool is typically accomplished by a clutch mechanism. In the past operation of the clutch mechanism is accomplished through direct manual control of clutch. This requires the operator to be standing next to the winch and manually operate a gear lever. As can be imagined if the operator is loading a vehicle or moving another type of large load, standing next to the winch may not be the most convenient or safe location.

What is needed is an apparatus that allows a winch operator to engage and disengage a clutch without standing next to the winch.

BRIEF SUMMARY OF THE INVENTION

The present invention achieves its objections by providing an electronic actuated clutch for a winch. The winch having a motor and drive shaft which are engagable, via an electronically actuated clutch, to a spool. The clutch being operated by a solenoid which engages the clutch via a yoke. The clutch is operable between an engaged and disengaged position through energizing and de-energizing the solenoid. Operation of the clutch moves it linearly along the axis of the drive shaft into and out of engagement with the spool. Operation of the electronically actuated clutch may be done via a remote control.

BRIEF DESCRIPTION OF THE DRAWINGS

Preferred embodiments of the invention will now be described in further detail. Other features, aspects, and advantages of the present invention will become better understood with regard to the following detailed description, appended claims, and accompanying drawings (which are not to scale) where:

DETAILED DESCRIPTION OF THE PREFERRED EMBODIMENT(S)

Figure 1:
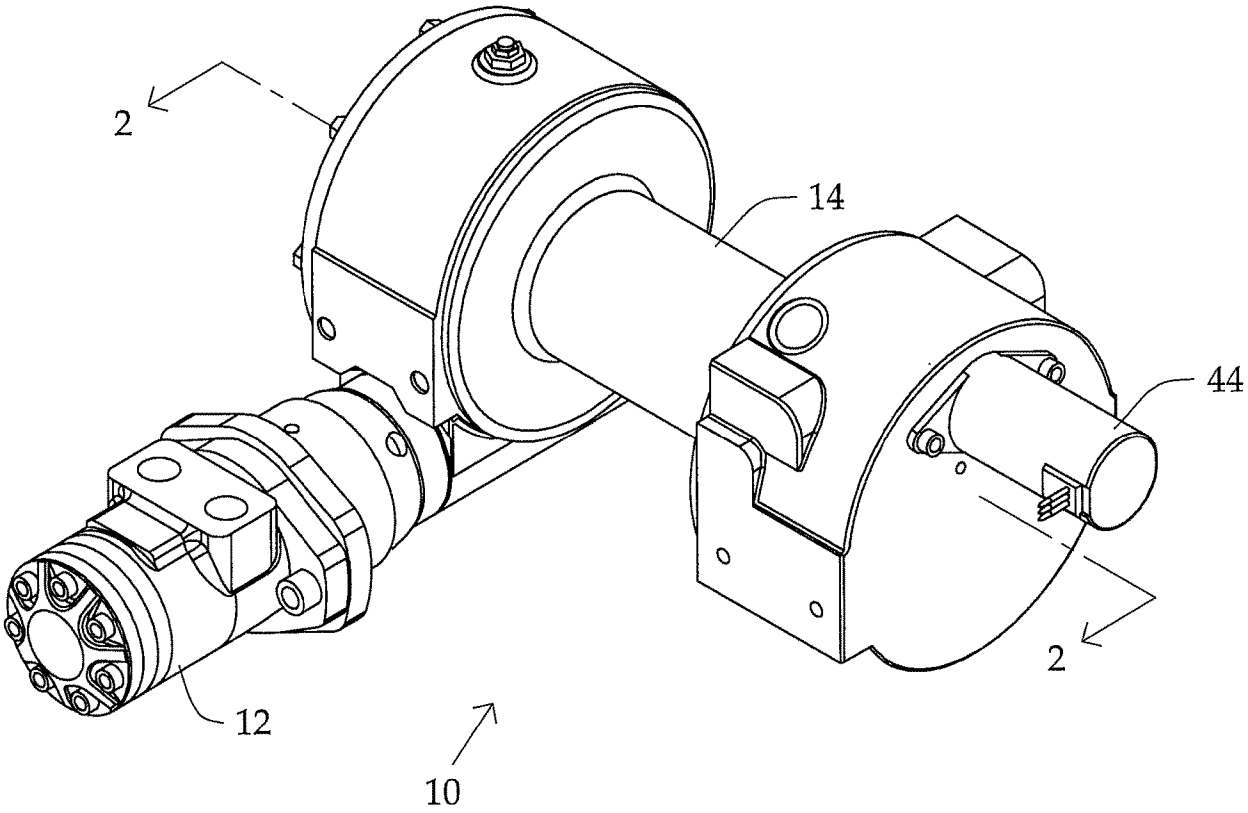
FIG. 1 is a perspective view of the preferred embodiment of the present invention.
Figure 2:
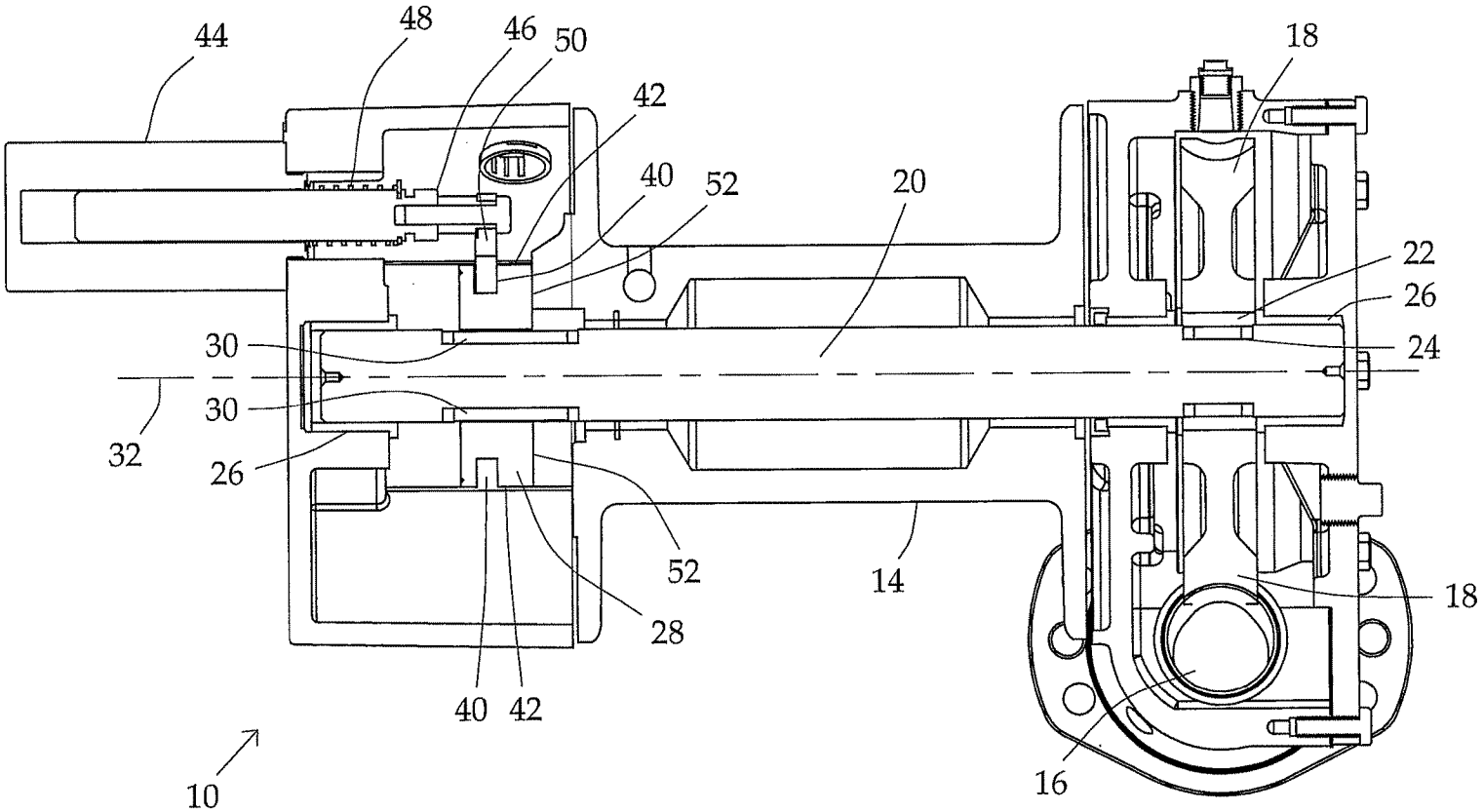
FIG. 2 is a sectional view of the preferred embodiment of the present invention.
Figure 3:
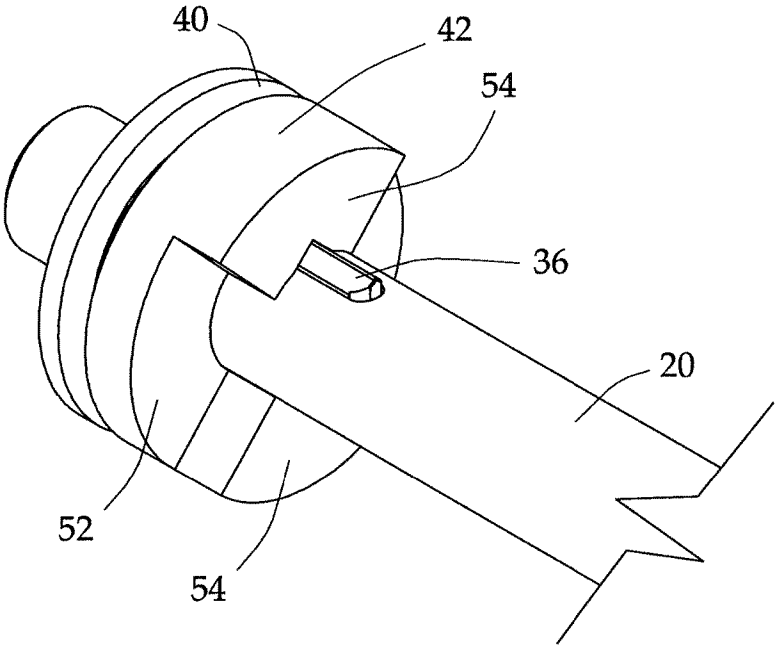
FIG. 3 is a prospective view of one embodiment of the clutch and drive shaft.
Figure 4:
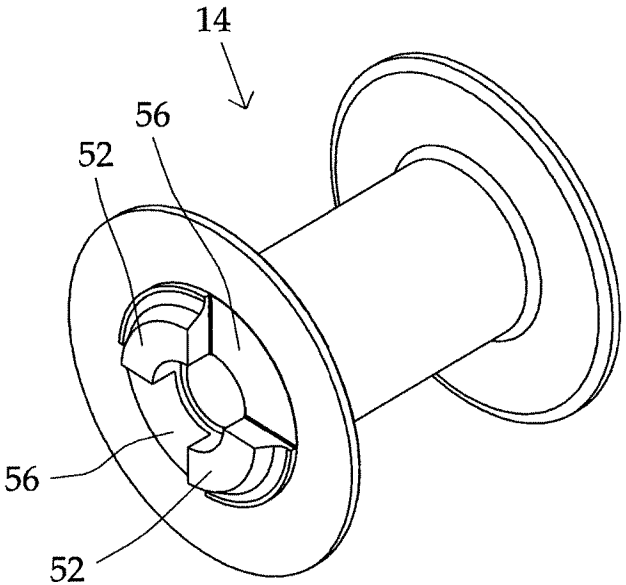
FIG. 4 is a prospective view of one embodiment of the spool complementary to the clutch shown in FIG. 3.
Figure 6:
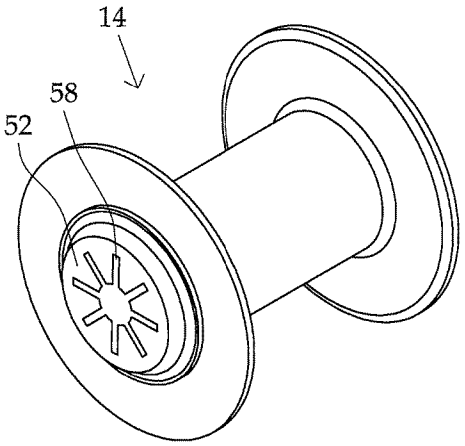
FIG. 6 is a prospective view of one embodiment of the spool complementary to the clutch shown in FIG. 5.
Figure 5:
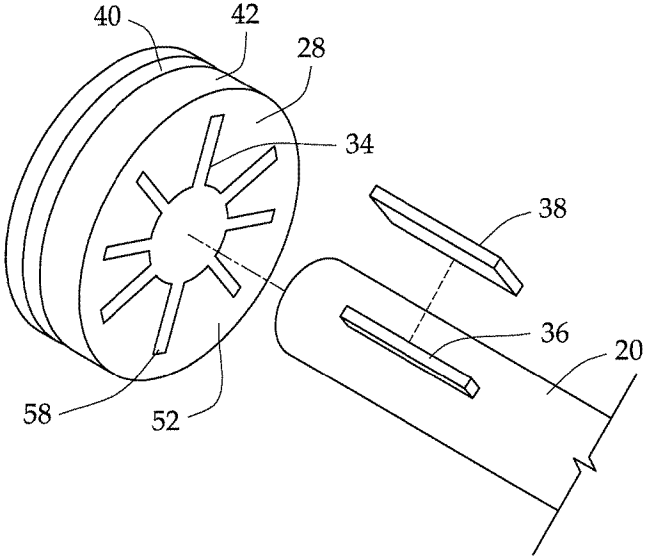
FIG. 5 is a prospective view of one embodiment of the clutch and drive shaft.

Turning now to the drawings wherein like reference characters indicate like or similar parts throughout, FIG. 2 is a cross section of the preferred embodiment of the present invention. The winch 10 is powered by a motor 12 shown on the a first side of the spool 14. The motor 12 rotates a worm 16 which engages with and rotates a worm gear 18. The worm gear 18 is secured to the drive shaft 20 by one or more keys 22 and keyways 24. The worm gear 18 could also be secured to the drive shaft 20 by other means including but not limited to an interference fit between the two parts, casting or machining these two parts out of a single piece of metal or welding the worm gear 18 to the drive shaft 20.

The drive shaft 20 is rotatably mounted in the winch 10 by a bushing 26 located on each end of the drive shaft 20. The drive shaft 20 passes through the center of the spool 14. However, without engagement of the clutch 28 the spool 14 rotates free of the drive shaft 20.

A clutch 28, found on the second side of the spool 14, engages the drive shaft 20 to the spool 14 via one or more keyways 30 located in the drive shaft 20. The keyways 30 allow for linear movement of the clutch 28 along the axis 32 of the drive shaft 20. However they prevent rotation of the clutch 28 relative to the drive shaft 20. The keyways 30 can take numerous forms. In the preferred embodiment there is one or more grooves 34 in the center of the clutch 28 with each groove 34 having a complementary notch 36 extending outward from the drive shaft 20. Other embodiments include but are not limited to corresponding keyways 30 in the drive shaft 20 and clutch 28 with complementary key 38 to lock the two pieces together rotationally.

The clutch 28 has a continuous groove 40 along its peripheral edge 42. The solenoid 44 has a plunger 46 which is biased in an extended position by a spring 48. A yoke 50 extends from the plunger 46 and engages the continuous groove 40. When the solenoid 44 is de-energized (and the spool 14 and drive shaft 20 are engaged), as seen in the attached FIG. 2, the clutch 28 engages the spool 14 and the spool 14 rotates with the drive shaft 20.

When the solenoid 44 is energized the spool 14 and drive shaft 20 are disengaged. Thus the spool 14 rotates freely without any engagement with the drive shaft 20. This is useful to payout line from the spool 14. This is accomplished by the yoke 50 causing the clutch 28 to move linearly relative to the drive shaft 20 along the drive shaft axis 32 as the plunger 46 is retracted into the solenoid 44. The clutch 28 is engaged by de-energizing the solenoid 44. The bias of the spring 48 will then cause the plunger 46, yoke 50 and clutch 28 to move linearly (to the right as seen in FIG. 2 along the drive shaft 20 and drive shaft axis 32. This in turn causes the clutch 28 and drive shaft 20 to engage with the spool 14. Operation of the solenoid 44 and in turn the clutch 28 may be done via a wired or wireless remote control.

Engaging surfaces 52 between the clutch 28 and spool 14 can take various forms as best seen in FIGS. 3-6. In the preferred embodiment the clutch has one or more fingers 54 which extend from the clutch 28 towards the spool 14. The spool has corresponding complementary opening 56 which interlock with these fingers 54. See FIGS. 3 and 4 Other embodiments of the engaging surfaces 52 include but are not limited to complimentary interlocking geometric shape 58 located on these surfaces 52. See FIGS. 5 and 6.

The foregoing description details certain preferred embodiments of the present invention and describes the best mode contemplated. It will be appreciated, however, that changes may be made in the details of construction and the configuration of components without departing from the spirit and scope of the disclosure. Therefore, the description provided herein is to be considered exemplary, rather than limiting, and the true scope of the invention is that defined by the following claims and the full range of equivalency to which each element thereof is entitled.

What is claimed is:

1. A winch comprising:

a clutch configured to slide in a linear direction parallel to a winch drive shaft axis;

and an electronic solenoid configured to cause the clutch to slide in the linear direction; the electronic solenoid including a plunger arranged parallel to the winch drive shaft axis; and a yoke located toward an end of the plunger and arranged perpendicular to the winch drive shaft axis, the yoke free to move along the winch drive shaft axis at an end of the yoke opposite the plunger.

2. A winch according to claim 1, the electronic solenoid being biased towards an engaged position.

3. A winch according to claim 1, wherein the yoke is cantilevered from the plunger.

4. A winch according to claim 1, the clutch including:

a continuous groove extending around an outer periphery of the clutch;

wherein the yoke engages the continuous groove.

5. A winch according to claim 1, further comprising:

a spool in communication with a winch drive shaft and configured for engagement by the clutch.

6. A winch of according to claim 5, wherein the spool rotates freely of the winch drive shaft when the clutch is in a disengaged position.

7. A winch according to claim 5, further comprising:

an engaging surface located on the clutch; and a complementary engaging surface located on the spool.

8. A winch according to claim 7, wherein in the engaging surface of the clutch and the complementary engaging surface of the spool have interlocking geometric shapes.

9. A winch according to claim 5, further comprising:

a finger extending out from the clutch; and a complementary sized and located opening for the finger located in the spool.

10. A winch according to claim 5, further comprising:

a winch drive motor located on one side of the spool;

the clutch being located on another side of the spool.

11. A winch according to claim 1, further comprising:

the clutch including one or more keys;

the one or more keys configured for engagement with a winch drive shaft and permitting the slide in the linear direction but preventing rotation of the clutch relative to the winch drive shaft axis.

12. A winch according to claim 1, further comprising:

the winch drive shaft including a keyway;

a corresponding keyway cut into the clutch; and a key captured in the keyway of the winch drive shaft and the corresponding keyway cut into the clutch.

13. A winch according to claim 1 further comprising:

a groove in the clutch; and a complementary notch extending outward from the winch drive shaft.

14. A method of electronically controlling a winch clutch, the method comprising:

de-energizing an electronic solenoid in communication with the winch clutch to cause the winch clutch to slide linearly along a winch drive shaft axis and engage a spool;

the electronic solenoid including a plunger arranged parallel to the winch drive shaft axis; and a yoke located toward an end of the plunger and arranged perpendicular to the winch drive shaft axis, the yoke free to move along the winch drive shaft axis at an end of the yoke opposite the plunger.

15. A method according to claim 14, wherein the yoke is cantilevered from the plunger.

16. A method according to claim 14, further comprising:

energizing the electronic solenoid; and rotating the spool independent of a winch drive shaft.

17. A method according to claim 14, wherein during the slide linearly along the winch drive shaft axis the clutch is prevented from rotation about the winch drive shaft axis.

* * * * *